United States Patent [19]

Parnes

[11] Patent Number: 4,620,408

[45] Date of Patent: Nov. 4, 1986

[54] ORBITAL STRETCH WRAPPING APPARATUS

[75] Inventor: Melvin G. Parnes, Milford, N.J.

[73] Assignee: Overwrap Equipment Corporation, Fairfield, N.J.

[21] Appl. No.: 614,194

[22] Filed: May 25, 1984

[51] Int. Cl.[4] ..... B65B 13/04

[52] U.S. Cl. ..... 53/77; 53/588; 53/556

[58] Field of Search ..... 53/77, 585, 556, 588; 74/612, 616

[56] References Cited

U.S. PATENT DOCUMENTS

| | | | |
|---|---|---|---|
| 1,493,504 | 5/1924 | Schuessler | 74/612 X |
| 1,860,625 | 5/1932 | Schettler | 74/612 |
| 4,110,957 | 9/1978 | Lancaster | 53/588 X |
| 4,166,348 | 9/1979 | Carlson | 53/588 X |
| 4,179,987 | 12/1979 | Dohm | 74/616 |
| 4,283,903 | 8/1981 | Mayhall | 53/587 |
| 4,403,463 | 9/1983 | Danti | 53/585 X |
| 4,461,136 | 7/1984 | Hodson | 53/556 X |

*Primary Examiner*—John Sipos

*Attorney, Agent, or Firm*—Blum Kaplan Friedman Silberman & Beran

[57] ABSTRACT

Improvements in an orbital stretch wrapping apparatus are provided for. The orbital stretch wrapping apparatus package support platform includes a package support finger or plurality of fingers positioned so as to be able to support the item being wrapped at its sides thereby facilitating package removal. Additionally, the orbital stretch wrapping apparatus incorporates a pair of safety panels featuring an electrical interconnect mechanism whereby the orbital stretch wrapping apparatus may not be operated until the safety side panels are extended to their full outward position, thereby reducing the danger of coming into contact with the moving stretch wrapping mechanism.

4 Claims, 7 Drawing Figures

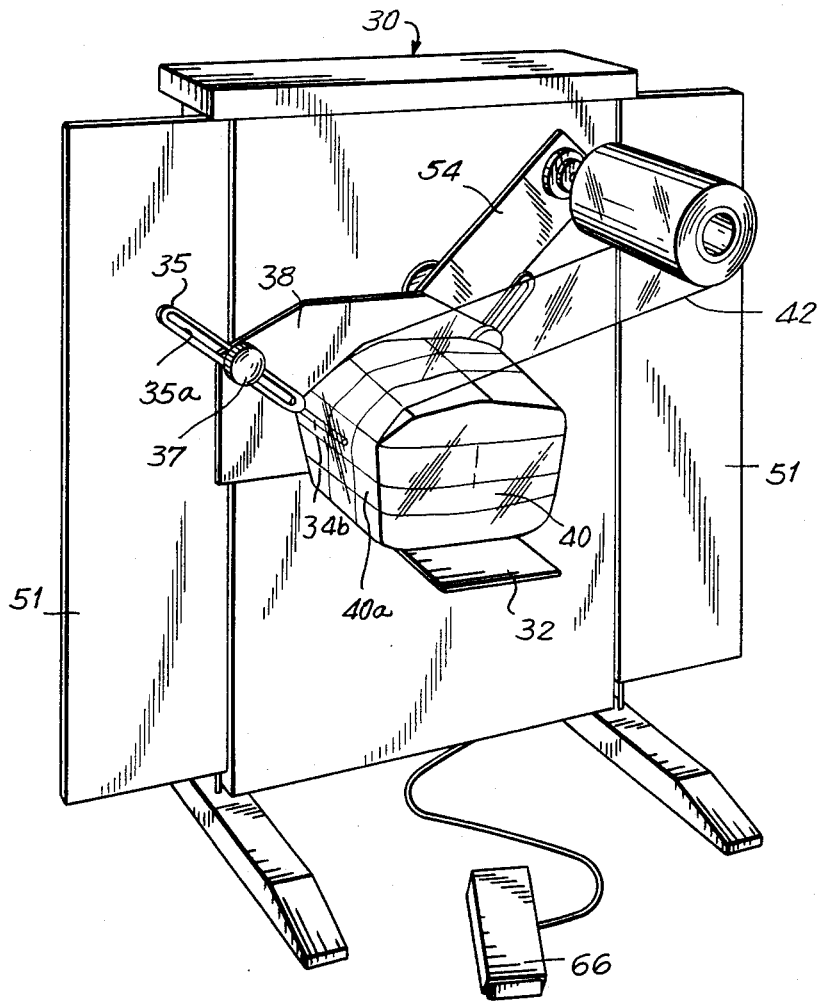
FIG. 3
FIG. 5
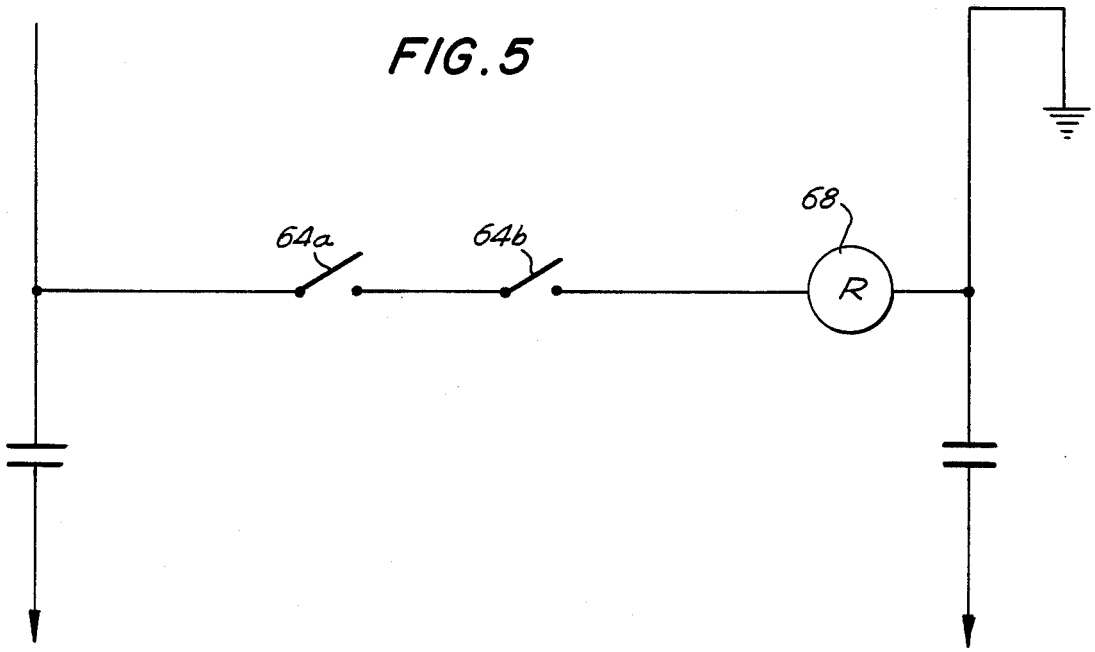

FIG. 4A
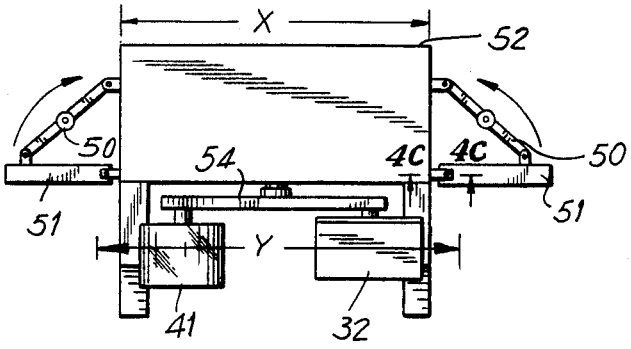
FIG. 4B
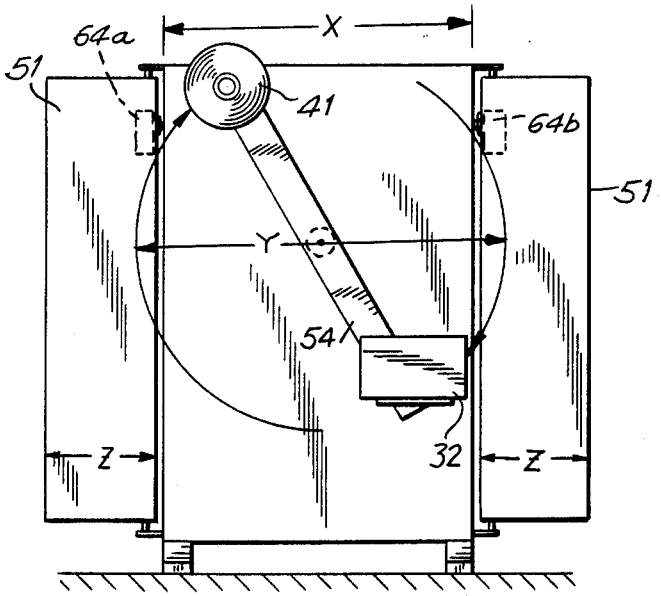
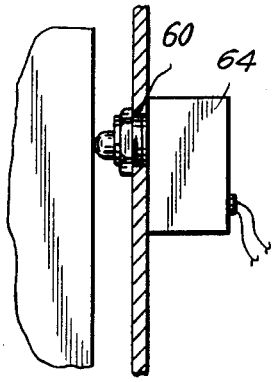
FIG. 4C

ORBITAL STRETCH WRAPPING APPARATUS

BACKGROUND OF THE INVENTION

This invention relates generally to an orbital stretch wrapping apparatus, and more particularly, to an orbital stretch wrapping apparatus incorporating an improved package support mechanism and safety panels.

Generally, it has been observed that in stretch bundling or stretch pallet wrapping packages, when a square package is contained inside a stretch wrap film, the film, which is under elastic tension, tries to re-form itself into its original shape. However, it cannot normally do so because of the rigid configuration of the package that is being wrapped. The result is that most of the force that is generated inwardly towards the package occurs at the corners of the package. Additionally, the amount of force exerted inwardly at the sides of the package, midway between the corners of the rectangular sections that are being wrapped, is minimal, and in some cases nonexistent.

In the conventional art, when a package which is to be wrapped is held at the corner points thereof, the stretch wrap film attaches itself to the holding device. This interferes with package removal. In one design, rigid angle brackets are used to hold the package being wrapped, which in turn forces a bottom holding plate to be positioned at the corners of the package. In a modification of this design, attachments are made to these package holding brackets to form right angles around the lower corners of the package. These attachements are intended to keep the package from moving in a lateral direction. However, these brackets are not completely satisfactory once a package is wrapped using these mechanisms it cannot be easily removed from the wrapping machine.

It has also been noted that a dangerous situation exists as a package is being wrapped, in that the wrapping assembly as it rotate moves outside of the physical linear dimension of the wrapping machine. If an individual is standing next to a wrapping machine and the wrapping mechanism begins to move during the wrapping cycle, the individual will most likely be pushed or hit by the moving package platform or the film holder spindle. A possible solution is to extend the length of the wrapping machine. However such a solution is expensive and impractical not only from the point of view of added fabrication and shipping costs but also because it makes it more difficult to move and transport the machine.

SUMMARY OF THE INVENTION

Generally speaking, in accordance with the present invention, improvements directed to an orbital stretch wrapping apparatus are provided. These improvements allow for increased convenience and safety in the operation of a stretch wrapping machine.

As a first improvement, an improved package support assembly is provided. The package support assembly includes a package support back plate, which is movably affixed to a first end of a rotatable stretch wrapping mechanism. A package support table is provided and is affixed to the package support back plate so that it is oriented parallel to the horizen. A plurality of slidably adjustable package support fingers are affixed to the package support back plate by hold down knobs. In operation, a package is held by the package support assembly. The package is placed on the package support table. The support finger hold down knobs are loosened, and the package support fingers are positioned proximate to the sides of the package. The hold down knobs are then retightened. In this way, the package will be stably and securely held during the wrapping process, and will also be easy to remove once wrapping is complete.

As a second improvement, an extendable safety panel assembly and electric circuit safety interlock mechanism is provided to an orbital stretch wrapping apparatus. The safety panel assembly includes a plurality of safety panels which are movably affixed to the orbital stretch wrapping apparatus cabinet. In operation, the safety panels are moved from a folded first position to an extended second position. This extension effectively increases the frontal linear dimension of the stretch wrapping apparatus cabinet, thereby preventing accidental movement into the operational area of the rotating stretch wrapping mechanism. The safety panel assembly may be additionally provided with an electric circuit safety interlock mechanism. The electric circuit safety interlock mechanism utilizes an electric switching system, such as a micro switch, which is mechanically positioned betwen the safety panel assembly and the stretch wrapping apparatus cabinet. The electric circuit safety interlock mechanism is electrically interposed between an operator's control, such as a foot switch, and the stretch wrapping mechanism motor. The electric circuit safety interlock mechanism is positioned on a safety panel so that when the safety panel is in a folded back first position no current can flow to the stretch wrapping mechanism motor, and when the safety panel assembly is extended to a second position a current path to the stretch wrapping mechanism motor is once again enabled. In this way operation of the orbital stretch wrapping apparatus is prohibited unless the safety side panel assembly is extended to a second position.

Accordingly, it is an object of the invention to provide improvements to an orbital stretch wrapping apparatus.

Another object of the invention is to provide an improved package support assembly for use in an orbital stretch wrapping apparatus.

Yet another object of the invention is to provide an improved safety mechanism for preventing injury while operating an orbital stretch wrapping apparatus.

Still another object of the invention is to provide improvements to orbital stretch wrapping apparatus which are low in cost and which admit of ease of manufacture.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which:

FIG. 3 is a perspective view of an orbital stretch wrapping apparatus in operation constructed in accordance with an embodiment of the invention;

FIG. 4*a* is a top plan view of a safety panel assembly constructed in accordance with an embodiment of the invention;

FIG. 4*b* is a front plan view of a safety panel assembly constructed in accordance with an embodiment of the invention;

FIG. 4*c* is an exploded view of an electric circuit safety interlock mechanism constructed in accordance with an embodiment of the invention;

FIG. 5 is a schematic representation of an electric safety interlock mechanism circuit used with a safety panel constructed in accordance with an embodiment of the invention.

DETAILED DESCRIPTION OF THE PREFERRED EMBODIMENTS

Figure 1:
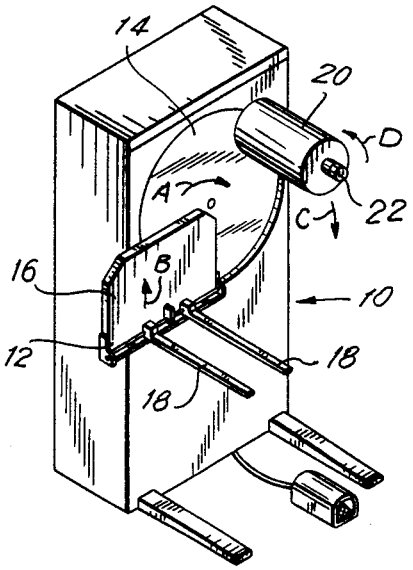
FIG. 1 PRIOR ART
FIG. 1 is a perspective view of a conventional orbital stretch wrapping apparatus.

By way of background, reference is made to FIG. 1 wherein a conventional orbital stretch wrapping apparatus, generally indicated as 10, of the type described in U.S. Pat. No. 4,226,397 is depicted. U.S. Pat. No. 4,226,397 is incorporated herein by reference as if fully set forth herein.

A rotatable stretch wrapping mechanism 14 is provided. A package support assembly 12 is movably affixed to stretch wrapping mechanism 14. Package support assembly 12 includes a package support back plate 16. Package support assembly 12 also includes package support fingers 18 which are adjustable in a horizontal direction and which are pivotally affixed to package support back plate 16. Rotatable stretch wrapping mechanism 14 also includes a wrapping material spindle 22. A roll of wrapping material 20, such as PVC film is mounted on wrapping material spindle 22 and one end is affixed to the item which is to be wrapped.

During operation of the conventional orbital stretch wrapping apparatus 10, rotatable stretch wrapping mechanism 14 moves in the direction of arrow A, causing package support assembly 12 to rotate in the direction of arrow B and wrapping material spindle 22 to move in the direction of Arrow C. Package support Assembly 12 rotates about its axis in a direction opposite the direction of wrapping mechanism 14. This further causes the roll of wrapping material 20 to rotate in the direction of arrow D. During this operation, a package (not shown in FIG. 1) which is supported by package support fingers 18 against package support back plate 16 is wrapped with wrapping material 20. Since the package being wrapped is only supported along its base by support fingers 18 it remains unstable and subject to adverse movement during the wrapping process. Additionally, if a package is positioned so that it is supported by being wedged between package support fingers 18, wrapping material 20 will bind package support fingers 18 to the package in a manner making removal of the package difficult.

As can also be seen in FIG. 1, once stretch wrapping mechanism 14 is moved in the direction of arrow A, package support assembly 12 describes a movement which extends beyond the front linear dimension of the stretch wrapping apparatus cabinet. This means that an individual standing proximate to the stretch wrapping apparatus while it is in operation may be struck by the moving package support assembly 12 or moving wrapping material spindle 22.

Figure 2:
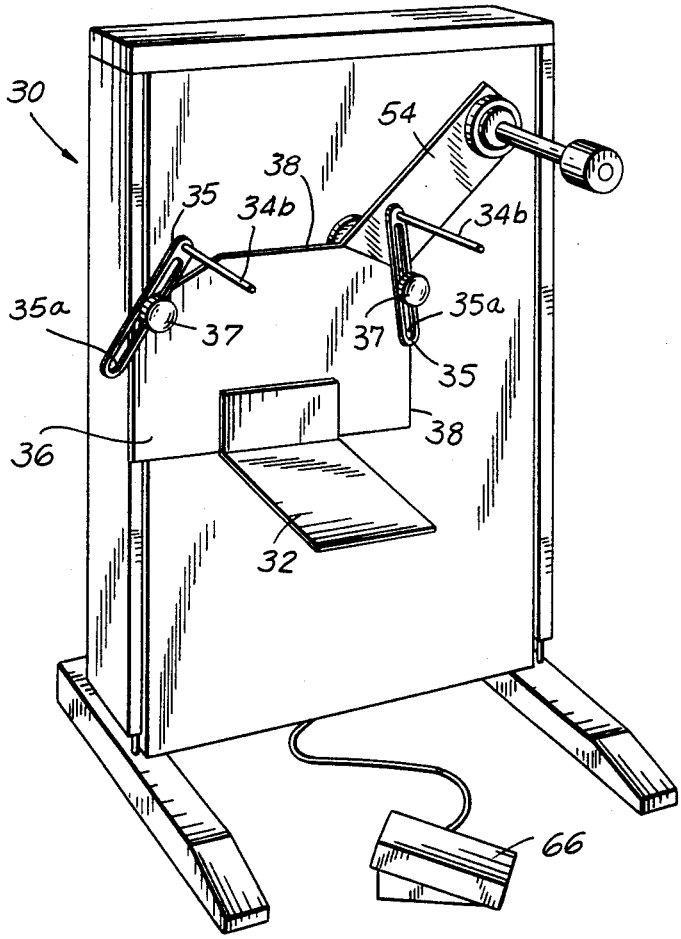
FIG. 2 is a perspective view of an orbital stretch wrapping apparatus constructed in accordance with an embodiment of the invention.

Referring now to FIGS. 2 and 3 an orbital stretch wrapping apparatus 30, constructed with improvements made in accordance with the invention, is shown. An improved package support assembly, generally indicated as 38, is shown. The package support assembly 38 includes a package support back plate 36 which is movably affixed (not shown) to the rotatable stretch wrapping mechanism 54 so that the package support assembly is rotated in the opposite rotary direction to the rotational movement of the stretch wrapping mechanism.

Package support table 32 is affixed to back plate 36 and is oriented so as to be parallel to the horizen. A plurality of package support finger mountings 34 are provided. Package support finger mounting 34 include a finger **34*b* and a sloted member 35 having an elongated slot 35*a* therein. Hold down knobs 37 are screwed through elongated slots 35*a* into a recess (not shown) provided in back plate 36, and permits the fingers 34*b*** to be adjusted to secure a package therebetween.

In operation, a package 40 (as shown in FIG. 3) is placed on package support table 32. Hold down knobs 37 are loosened and package support fingers **34*b* are moved into a position adjacent to the sides 40*a* of package 40. Hold down knobs 34** are then retightened.

This package support arrangement is advantageous over a conventional support assembly for two reasons. First, the introduction of individually adjustable package support fingers 34 provided in addition to package support table 32 results in an added number of support points of package 40 and yields a more stable package support assembly. Second, as has been noted above, the mechanical dynamics of the wrapping process tends to concentrate the force of contact of wrapping film 42 against the corners of the object which is being wrapped. If during operation the package which is being wrapped is supported at said same corners, then the package support assembly will become integrally attached to the package through the adhesion of the wrapping material. This makes it difficult to remove package 40 from the package support assembly once wrapping is complete.

As illustrated in FIG. 3, package support fingers **34*b* are adjustable and movably affixed to package support back plate 36 through the use of hold down knobs 35. In operation, support fingers 34*b* are moved to grip package 40 at its side 40*a*. When this occurs, a maximum amount of force is applied between wrapping material 42 and package 40 with a lesser amount of adhesion occurring between wrapping material 42, support fingers 34 and the side of the package 40*a*. In this way, ease of removal of the package once it is wrapped from the package support assembly 38** is facilitated.

In a preferred embodiment, package support assembly 38 includes a package support table 32 and a pair of package support fingers 34. However, in an alternate embodiment of the invention, package support table 32 may be replaced by a second pair of movable package support fingers **34*b* which are also slidably affixed to package support back plate 36 through the use of additional hold down knobs 37. Using this construction, a package being wrapped may be supported equally at all sides while allowing the wrapping material 42** to maintain maximum contact at the package corners and edges.

Referring now to FIGS. 4*a*, 4*b* and 4*c*, a safety panel assembly, generally indicated as 50, and constructed in accordance with an embodiment of the invention is shown. As illustrated, stretch wrapping apparatus cabinet 52 has a linear dimension X which is less than the diameter Y of a circle described by the movement of rotatable stretch wrapping mechanism 54. If an individual is positioned within the sweep of wrapping mechanism 54 while the machine is turned on, there is a great likelihood that the individual will be struck and injured by the moving package support assembly or wrapping material spindle. It is therefore desirable to enclose or otherwise discourage movement into the area described by the motion of rotatable stretch wrapping mechanism 54.

While it would be possible to enlarge the dimension of the cabinet of the orbital stretch wrapping apparatus, this would be undesirable since it would also increase the cost of manufacture and difficulty of shipment, and would reduce the ease of operation. As shown in FIGS. 4*a*, 4*b* and 4*c*, a movable safety panel assembly generally indicated as 50 is provided. Safety panel assembly 50 includes a pair of safety panels 51 which are pivotably affixed to the ends of the orbital stretch wrapping apparatus cabinet 52. These safety panels 51 have a linear dimension Z which is equal to or exceeds the outside span of movement described by the rotating stretch wrapping mechanism and which is given by the equation Z equals or is greater than Y minus X.

Safety panel assembly 50 has a first position and a second position. In its first position, the safety panels 51 are folded flat against the sides of the stretch wrapping apparatus cabinet 52. This is the position that the panels are placed in when the machine is not in use, such as during shipment or storage. This can be seen in FIG. 2. Referring now to FIGS. 4*a* and 4*b*, safety panel assembly 50 is shown in its second position wherein safety panels 51 are extended so as to increase the front linear dimension of the orbital stretch wrapping apparatus cabinet 52. Therefore, in one embodiment of the invention, the safety panel assembly 50 and safety panels 51 are movably affixed to the orbital stretch wrapping apparatus cabinet 52 so as to extend the effective length of the cabinet and prevent accidental injury caused by human contact with the moving wrapping mechanism 54.

As noted, the above improvement disclosed by safety panel assembly 50 will reduce accidental injury. However, it is still possible that accidental operation of the machine may occur where an operator does not extend safety side panels 51. Accordingly, in another embodiment of the invention, an electric circuit safety interlock mechanism generally indicated as 60 is physically coupled to safety side panel assembly 50 and is electrically interposed between the operator control foot pedal 66 and the motor of the orbital wrapping device of the invention. As illustrated in FIGS. 4*c* and 5, a microswitch 64 or other electrical switching apparatus is installed at the junction of each safety panel 51 with respect to the stretch wrapping apparatus cabinet 52.

Referring now to FIG. 5, a schematic diagram of one embodiment of the electric circuit safety interlock mechanism is shown. A first microswitch 64*a* corresponds to the switching mechanism used on the left safety flap and a second microswitch 64*b* corresponds to the safety mechanism used on the right safety flap. A relay 68 or other switching means is electrically disposed in a serial fashion between the microswitches and the motor of the rotatable stretch wrapping mechanism. In this embodiment, if either flap remains unextended, its corresponding microswitch is not closed and power to the wrapping mechanism is interrupted. Thus, operation of the rotatable stretch wrapping mechanism is prevented unless the safety panels are extended to their second fully open position. This assures safe operation of the machine and eliminates unwanted an unintentional hazards.

Thus, these improvements overcome the aforenoted limitations in orbital stretch wrapping assemblies wherein packages which are to be wrapped are difficult to support and difficult to remove once wrapped. Additionally, these improvements overcome the dangerous situation which exists for the operator of a wrapping apparatus when he can be strucked by the moving wrapping mechanism during operation. It is thus apparent from the foregoing, that improvements in an orbital stretch wrapping apparatus are disclosed which eliminate the above noted difficulties and dangers.

It will thus be seen that the objects as set forth above, and those made apparent from the preceding descriptions, are efficiently attained, and since certain changes may be made in the above construction without departing from the spirit and scope of the invention, it is intended that all matter contained in the above description or shown in the accompanying shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An improved orbital stretch wrapping apparatus which comprises:

a rotatable stretch wrapping mechanism supported in a housing;

a wrapping material spindle rotably affixed to said wrapping mechanism;

a package support back plate movably affixed to said rotatable stretch wrapping mechanism and adapted to rotate in a rotary direction opposite to the rotary direction of said wrapping mechanism, said package support back plate including a platform that is disposed in a substantially horizontal position during rotation of the wrapping mechanism;

at least two substantially horizontal package support finger means affixed to said package support back plate at an elevation above said platform means for movably affixing said fingers in their substantially horizontal orientation to said back plate so that said fingers can be adjusted relative to said platform; and a locking means associated with each finger means for inhibiting the movement of said package support finger means once it has been positioned to hold said package against said platform.

2. The orbital stretch wrapping apparatus, as claimed in claim 1, wherein each said package support finger means includes a slotted member and each said locking means includes a hold down knob affixed to said package support backplate, said package support finger means being positioned between said hold down knob and said package support back plate such that when said hold down knob is loosened, said package support finger is rendered movable, and when said hold down knob is tightened said package support finger is rendered stationery.

3. An orbital stretch wrapping apparatus, as claimed in claim 1, and including first and second safety panels pivotally secured to said housing and being adapted to be pivoted from a first position to a second position wherein said panels extend the front linear dimension of said housing so that the radius of rotation of said wrapping material spindle and said support fingers is within the linear dimension of said housing.

4. The orbital stretch wrapping apparatus, as claimed in claim 3, including a motor means for driving said wrapping mechanism and electro-mechanical switch means electrically coupled to said motor means and mechanically coupled to said panels, said switch means being adapted to prevent said motor means from operating when said panels are not in said second position.

* * * * *